US009522406B2

(12) United States Patent
DeMott, III

(10) Patent No.: US 9,522,406 B2
(45) Date of Patent: Dec. 20, 2016

(54) PORTABLE PAINT SHIELD

(71) Applicant: Alfred S. DeMott, III, North Palm Beach, FL (US)

(72) Inventor: Alfred S. DeMott, III, North Palm Beach, FL (US)

( * ) Notice: Subject to any disclaimer, the term of this patent is extended or adjusted under 35 U.S.C. 154(b) by 0 days.

(21) Appl. No.: 14/025,156

(22) Filed: Sep. 12, 2013

(65) Prior Publication Data

US 2014/0069332 A1 Mar. 13, 2014

Related U.S. Application Data

(60) Provisional application No. 61/700,074, filed on Sep. 12, 2012.

(51) Int. Cl.

| | |
|---|---|
| ***B05B 15/04*** | (2006.01) |
| ***B05C 21/00*** | (2006.01) |
| *B05B 9/04* | (2006.01) |

(52) U.S. Cl.

CPC ..... *B05B 15/04* (2013.01); *B05B 15/0406* (2013.01); *B05C 21/005* (2013.01); *B05B 9/0403* (2013.01)

(58) Field of Classification Search

CPC .... B05B 15/04; B05B 15/0406; B05B 9/0403; B05C 21/005; Y10S 239/22

USPC ..... 118/504, 505, 301; 239/104

See application file for complete search history.

(56) References Cited

U.S. PATENT DOCUMENTS

| | | | | |
|---|---|---|---|---|
| 3,027,870 | A * | 4/1962 | Schirmer | 118/504 |
| 3,434,416 | A * | 3/1969 | Testone | 101/416.1 |
| 3,633,542 | A | 1/1972 | Read et al. | |
| 4,051,808 | A | 10/1977 | Trupp | |
| 4,085,703 | A | 4/1978 | Glowacki | |
| 4,217,854 | A * | 8/1980 | Brown | 118/504 |
| 4,248,914 | A | 2/1981 | McClane | |
| 4,574,731 | A | 3/1986 | Stevens et al. | |
| 4,765,353 | A | 8/1988 | Rhoades | |
| 4,792,191 | A * | 12/1988 | Farmer | 301/37.102 |
| 4,895,306 | A * | 1/1990 | Whitehurst, Jr. | 239/288 |
| 5,103,762 | A | 4/1992 | Long et al. | |
| 5,155,933 | A | 10/1992 | Claussen et al. | |
| 5,342,447 | A | 8/1994 | Nudo et al. | |
| 6,808,794 | B1 | 10/2004 | Mattox | |
| 2010/0126416 | A1 | 5/2010 | Gringer | |

* cited by examiner

*Primary Examiner* — Laura Edwards

(74) *Attorney, Agent, or Firm* — McHale & Slavin, P.A.

(57) ABSTRACT

A paint shield for releasable attachment to the head of a paint gun sprayer is disclosed for preventing overspray from contacting other exposed surfaces or components outside of the intended surface. The paint shield is comprised of a single planar sheet of flexible, sturdy, impermeable material, such as aluminum. The shield includes a base panel through which the nozzle of the spray gun is secured. A pair of contoured members extend away from the base member to make contact with the adjoining pavement, ground, or wall to establish the distance and the angle in which the nozzle is maintained from the surface. This construction assures that the width and angular velocity of the spray evenly covers the surface without undue waste. The paint shield may be preformed for specific cross sections of objects such as curbing or gutters.

10 Claims, 2 Drawing Sheets

PORTABLE PAINT SHIELD

REFERENCE TO RELATED APPLICATION

In accordance with 37 C.F.R 1.76, a claim of priority is included in an Application Data Sheet filed concurrently herewith. Accordingly, the present invention claims priority under 35 U.S.C. §119(e) to U.S. Provisional Application 61/700,074, entitled "PORTABLE PAINT SHIELD" filed on Sep. 12, 2013. The contents of each of the above referenced applications are herein incorporated by reference in its entirety.

FIELD OF THE INVENTION

The present invention generally relates to paint sprayer accessories; and more specifically, to a paint sprayer accessory for use with surfaces such as curbs, parking bumpers, or other objects having a consistent cross sectional shape to eliminate the misapplication of paint and overspray when using a spraying apparatus.

BACKGROUND OF THE INVENTION

Paint is generally any liquid, liquefiable, or mastic composition which, after application to a substrate in a thin layer, is converted to a solid film. It has been used for over 40,000 years to protect, color, or provide texture to objects. Paint can be applied as a solid, as a gaseous suspension or as a liquid depending on the size of the object to be painted and the type of results desired. The amount of paint that is misplaced is largely a matter of the care of the painter, the type of tools the painter uses, and the size of the project. Certain tools, like rollers and brushes, generally put paint where it is wanted and require only thin strips of masking tape to segregate painted from unpainted surfaces. On a small project, masking surfaces adjacent to those in need of painting is not very time consuming. However, larger projects, like commercial settings where an entire house, building, or other structure must be painted make masking tape an unacceptable choice. In these circumstances, it has become common for painters to employ airless spray painting to accomplish the task. This form of painting utilizes a high-pressure pump that forces paint through a spray nozzle into a misting shower. Unlike spray guns that are used in conventional automobile and furniture painting, no air is mixed with the paint. While airless spray painting provides an extremely swift means for coating the surfaces of large structures, it has its drawbacks. In particular, it is difficult to create or frame a straight line around regular and irregular edged surfaces due to overspray, which occurs as the paint exits the nozzle of the spray gun. Masking tape, paper or plastic sheeting is often applied to form a protective shield to insure a complete and well defined surface for the application of paint, but this is costly from the standpoint of products used, and perhaps more significantly, from the aspect of additional labor required. Furthermore, when masking tape is not removed properly, it leaves a residue that is quite sticky and difficult to clean. Additionally, plastic and paper sheeting, because of their inherent flexibility, can move from their original positions during use, permitting paint to reach areas where it was not intended. To avoid the problems associated with masking tape, and to protect a non-designated surface or wall from the misapplication of paint while using a high pressure spray gun, painters have improvised by using hand-held paint shields formed with a strip of cardboard, aluminum or other suitable material.

Such shields are held against a surface with one arm, leaving the other arm to use the sprayer, brush, or roller. As such, these shields become very difficult to hold in place while painting and are limited to straight edges. Corners, curves and irregular surfaces are therefore limited to masking with tape and sheeting.

Many objects may include curves or corners but include a constant cross sectional shape, and masking is required only to isolate them from their background. For example, curbs, parking bumpers, and the like include a constant cross sectional shape and require protective masking only to prevent the overspray of paint from hitting surrounding surfaces. The painting of curbs and parking bumpers is so common that the U.S. Department of Transportation has published "A Manual on Uniform Traffic Control Devices for Streets and Highways" that covers not only striping of roadways and highways, but also addresses the subject of curb painting. A curb is the edge where a raised pavement, sidewalk, footpath, road median or road shoulder meets an un-raised street or other roadway. Curbs separate the road from the roadside, discouraging drivers from parking or driving on sidewalks or lawns. They also provide structural support to the pavement edge. Curbs can be used to channel runoff water from rain, or melted snow and ice into storm drains. Curbs are effective at channeling motor vehicle traffic. There is also an aesthetic aspect, in that curbs look formal and "finished", adding to the orderly appearance of the surrounding property. Other types of curbs include parking curbs.

Municipal jurisdictions throughout the United States often have established requirements for curb painting, particularly with relation to color coding for location and identification of the purpose of the curbed areas. The significance of the use of color-coding on curbs can best be described by colors as follows: Red zones are "No Parking" zones. They may be installed near intersection corners, at certain bus stops, at fire hydrants, at curb ramps, and most commonly, at edges of driveways. White zones are for passenger loading and unloading with a time limit of five minutes. The driver must remain with the vehicle at all times, with limited exceptions at preschools and hospitals. Typical establishments that may qualify for a white zone are hospitals, senior centers, medical offices with five or more practitioners, restaurants with 100 or more seats, theaters, churches, schools or government buildings. Green zones are for short-term parking, generally less than 10 minutes. Green can be applied in both metered and non-metered areas. Business establishments such as dry cleaners, florists, small neighborhood groceries, postal shipping centers and hardware stores may apply for short term parking privileges in front of their establishments. Yellow zones are for active freight loading and unloading only by commercial vehicles. Blue zones designate parking spaces for persons with valid disabled parking permits. Hence, brightly painted visible curbs help increase driver awareness and ensure safety for both vehicle operators and pedestrians. The adjoining roadway is often color coded as well, designed to direct or advise motor vehicle operators traveling over or parking in the paved areas. Thus, the importance of an orderly and clear application of colors can readily be understood.

Unfortunately, wear on the curbs from weather and vehicles bumping and rubbing against them cause damage to the painted surface; thereby requiring the re-painting of the curb to increase driver awareness. Because of the unconventional shape of a curb, using a paint sprayer typically causes excessive overspray onto undesired areas. In a parking lot with over 100 parking stalls, a painter would be required to place a masking barrier around all of the curbs before beginning the spraying. This would inevitably take considerable time and effort. Thus, what is needed in the art is a paint shield attachable to a paint gun sprayer that protects the area around a curb, parking curb, or other object having a constant cross-sectional shape from misapplication of paint when using a spraying apparatus. The paint shield of the instant invention would eliminate the need for the application of masking tape and plastic or paper sheeting around a curb, parking curb, or other object having a constant cross-sectional shape. The paint shield would thereby assist in the timely application of paint and reduce labor cost regardless of the dimension, curvature or location of a curb, parking curb, or other object having a constant cross-sectional shape.

SUMMARY OF THE INVENTION

A paint shield for releasable attachment to the head of a paint gun sprayer is disclosed for preventing overspray from contacting other exposed surfaces or components outside of the intended surface, such as a curb, parking curb, or other object having a constant cross-sectional shape. The paint shield is comprised of a single planar sheet of flexible, sturdy, impermeable material, such as aluminum, that can be modified to meet the specific need for which it is being utilized. The shield includes a base panel through which the nozzle of the spray gun is secured. A pair of contoured members extend in the same direction away from the base member that make contact with either the adjoining pavement, ground, or wall to frame the bounds of the intended painted surface. The contoured members also serve to establish the distance in which the nozzle is maintained from the surface and the angle at which the nozzle is directed toward the surface. This construction assures that the width and angular velocity of the spray evenly covers the surface without undue waste. The paint shield may be preformed for specific cross sections of objects such as curbing or gutters; or alternatively, the paint shield may be available as a planer member having a predetermined number of perforated lines or pre-bends running along the width thereof. The perforated lines allow for easy folding therealong and manipulation of the planar sheet in various shapes to accommodate various curbs or other objects having a constant cross-sectional shape.

Accordingly, it is an objective of the present invention to provide a paint shield that protects the surfaces adjacent to that which is being painted from receiving an unwanted application of the paint.

A further objective of the present invention is to provide a paint shield that will eliminate the need for the use of masking tape, paper or plastic sheeting to be affixed to the adjacent surfaces during the painting process, and reduce product and labor expense.

Another objective of the present invention is to provide a paint shield that maintains the spray nozzle a predetermined distance from the surface being painted.

Yet another objective of the present invention is to provide a paint shield that orients the angle of the spray nozzle with respect to the surface being painted.

Still yet another objective of the instant invention is to provide a paint shield that can, with only a minimum of training, be folded into the desired shape by hand and then later unfolded, avoiding the need for use of tools which the paint sprayer would have to carry with him or her to and on the immediate job site.

It is still another objective of the instant invention to provide a paint shield that protects a surface not intended for paint from misapplication when using a spraying apparatus to paint a curb, parking curb, or other object having a constant cross-sectional shape.

It is still yet another objective of the instant invention to provide a paint shield constructed of a substantially rigid material such as aluminum that may additionally include at least one removable liner on the inner surface of the paint shield for cleanup.

It is still another objective of the instant invention to provide a paint shield constructed of cardboard having laminated metal running through the length thereof for easy manipulation of the paint shield into a desired shape.

Yet another objective of the instant invention is to provide a paint shield that is suitable for use with objects having a constant cross-section throughout, such as pipes, railings, gutters, or the like.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
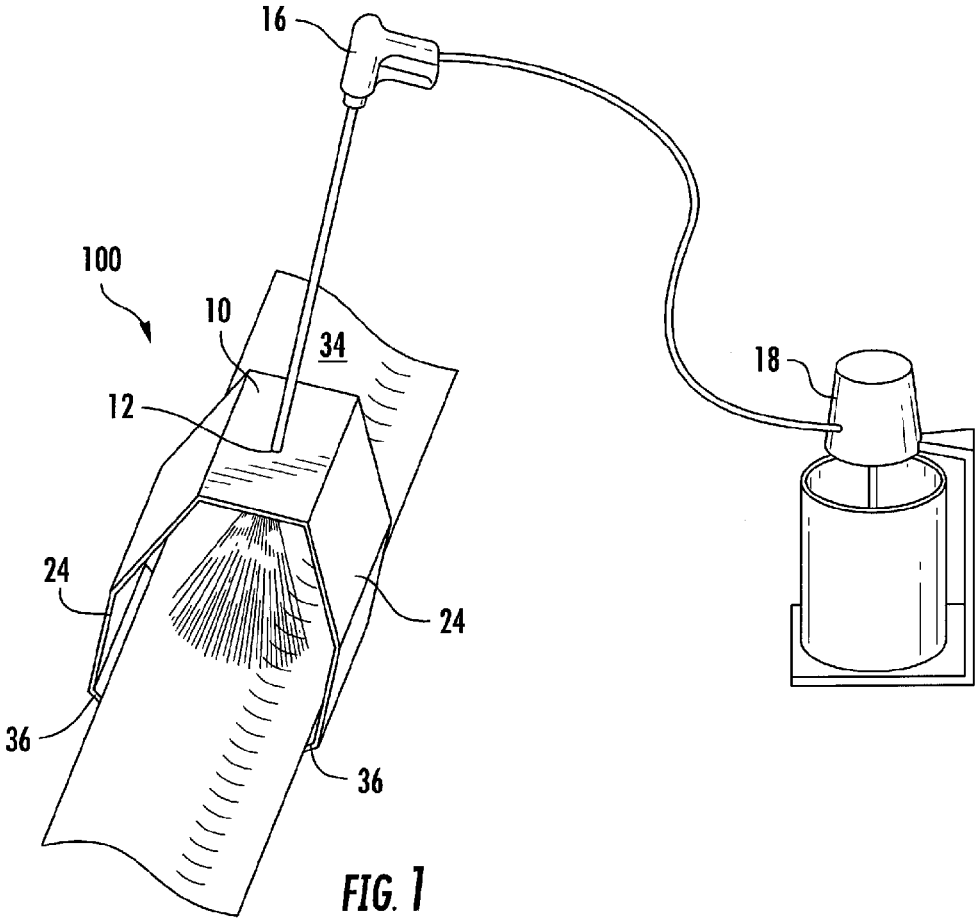
FIG. 1 is perspective view of the paint shield attached to the head of a paint gun sprayer.
Figure 2:
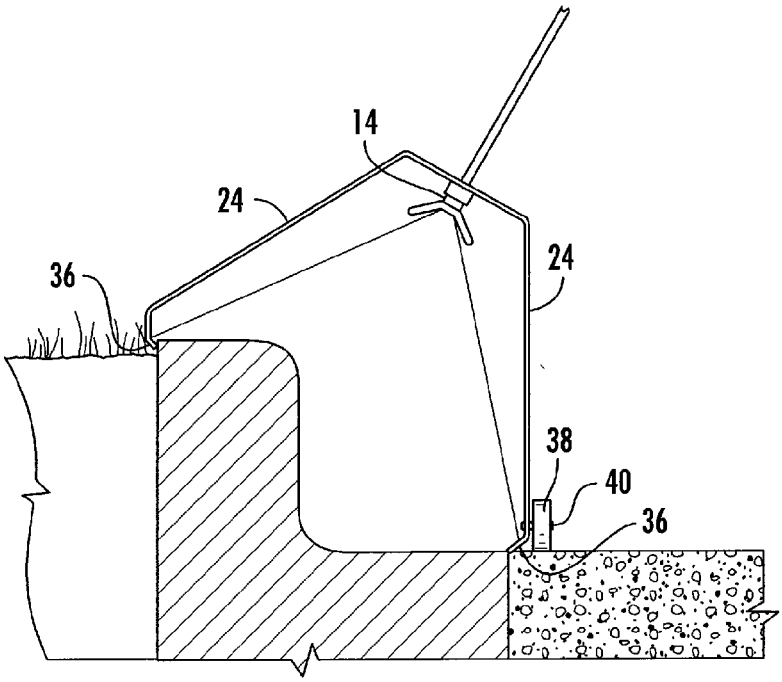
FIG. 2 is an end view of the paint shield constructed for use with a curb.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 3:
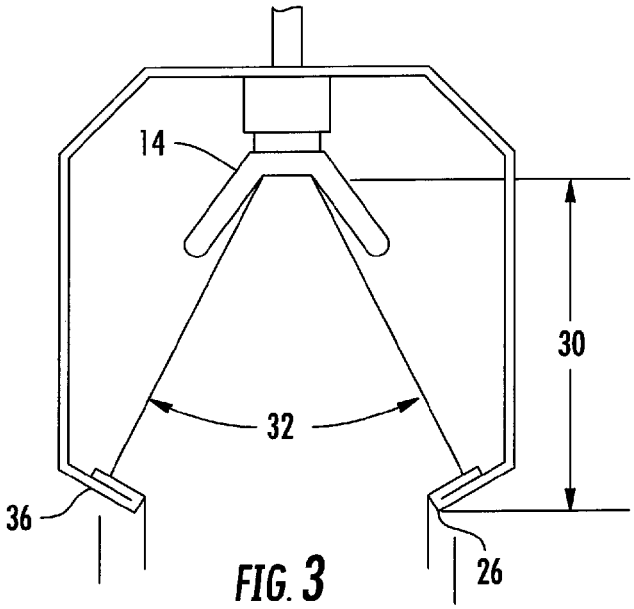
FIG. 3 is an end view of the paint shield constructed for use with a roofing gutter.

Referring generally to FIGS. 1-4B, various embodiments of the paint shield are illustrated. In general, the paint shield is constructed and arranged to orient and maintain proper spacing of the spray nozzle from an irregular surface while containing overspray to minimize spray being deposited onto adjacent surfaces. The paint shield 100 includes a top plate 10, the top plate including an aperture 12 sized to cooperate with a nozzle portion 14 of a spray gun 16 fluidly connected to a pump assembly 18. In operation, the nozzle portion is removed from the gun and a portion of the gun is placed through the aperture before the nozzle is threaded back onto the gun, whereby the paint shield is secured to said spray nozzle. In an alternative embodiment, a rubber grommet 20 (FIG. 4B) is secured into the aperture 12. The rubber grommet is constructed with a center aperture 22 sized to cooperate with the nozzle of the spray gun to attach the paint shield to the nozzle without removing the nozzle from the spray gun. A pair of sidewalls 24 are secured to opposite sides of the top plate 10. The sidewalls 24 are connected to the top plate 10 at an angle that allows a bottom surface 26 of the sidewalls 24 to extend at least the width of the surface to be painted without obstructing the path of the spray. The sidewalls are constructed of a substantially rigid material to include a width 28 (FIG. 4A) and a height 30 (FIG. 3). The sidewall width 28 is greater than the width of the splay angle width of the spray created by the nozzle at a bottom portion of said sidewalls. The sidewall height 30 is calculated from the opening in the nozzle to the bottom portion of the sidewalls so that the included spray angle 32 created by the nozzle 14 causes the spray to contact each sidewall 24 at a bottom portion thereof. In this manner, the nozzle 14 is maintained at a sufficient distance and angle from the surface being painted 34 so that said surface is covered with a surface coating and the spray is substantially contained within the paint shield 100.

In at least some embodiments, each sidewall includes a foot portion 36 secured to the bottom surface 26 of each sidewall 24, each foot portion is constructed and arranged for movement along a ground surface. In a most preferred embodiment, the foot 36 is constructed as a hem which may be open (FIGS. 1 and 2) or closed (FIG. 3). The closed hem provides a rounded edge which engages the surface to be painted. In some embodiments, the foot 36 is secured to the sidewall at an oblique angle whereby a bottom surface of the foot contacts a side surface of the surface being painted, whereby said spray is further contained and the foot acts as a guide member. In an alternative embodiment, the foot may include at least one wheel 38 mounted for rotation about an axle 40. In this manner, the foot provides guidance against a side surface while the wheel(s) maintain proper vertical spacing for the spray pattern. The paint shield 100 is preferably constructed from a rigid lightweight metal material such as aluminum. In these embodiments the paint shield is supplied in a prebent form whereby like bent paint shields may be nested on top of each other for shipment and storage.

Figure 4B:
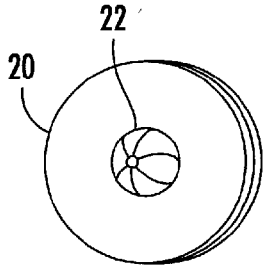
FIG. 4B is a perspective view of a rubber seal suitable for use with the present invention.
Figure 4A:
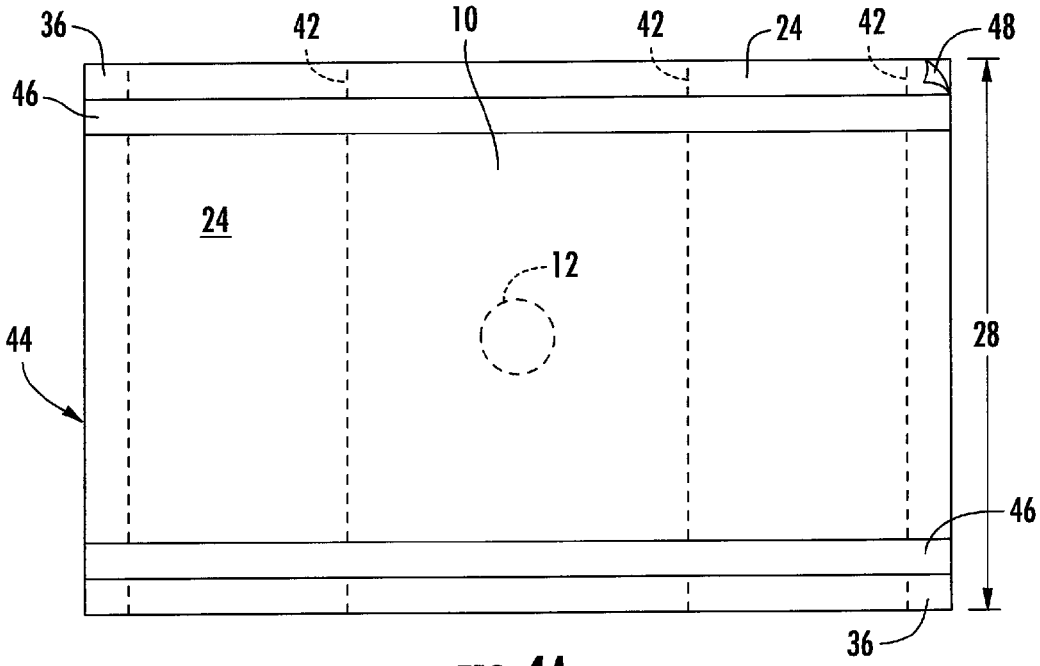
FIG. 4A is a front view of an alternative embodiment of the paint shield, illustrated in a flat foldable state.

Referring to FIGS. 4A and 4B, an alternative embodiment of the paint shield 100 is illustrated. In this embodiment, the paint shield is supplied as a planar sheet 44 having a plurality of prebend joints 42, whereby the paint shield is easily bent to a desired shape along the prebend joints. At least one, and more preferably two or more metal strips 46 are adhered, laminated, embedded or otherwise connected to the planar sheet to maintain the bends for use of the paint shield. The planar member may be constructed from very thin metal such as aluminum, or alternatively it may be constructed from paper material such as cardboard or plastic so long as the material will prevent paint from being transferred through the material during use. In at least one embodiment, a removable liner 48 is secured to the inner surface of the planar member. The liner may be removed after use to speed cleanup and allow further use of the paint shield. A plurality of liners in a stacked arrangement may also be utilized without departing from the scope of the invention.

While illustrated as useful for painting curbing, it should be noted that various regular and irregular shaped surfaces having a constant cross-section throughout such as piping, gutters, railings, or the like may be suitably masked for painting with the paint shield of the present invention without departing from the scope of the invention.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A paint shield for spray painting comprising:

a planar sheet having a plurality of prebend joints, whereby said paint shield is easily bendable along said prebend joints to form a top plate and a pair of side walls, said top plate including an aperture sized to cooperate with a nozzle portion of a spray gun so that said paint shield is secured to said nozzle portion by said aperture;

said pair of sidewalls formed at opposite sides of said top plate, said sidewalls connected to said top plate at an angle that allows a bottom surface of said sidewalls to extend at least the width of the surface to be painted, said sidewalls being constructed of a substantially rigid material to include a width and a height, each said sidewall includes a first foot portion formed as a portion of said sidewall at an angle, whereby a bottom surface of each said foot portion is configured to contact a side surface of said surface being painted, each said foot portion secured to said bottom portion of each said sidewall, each said foot portion being constructed and arranged for movement along a ground surface and acting as a guide member establishing a distance between said nozzle and surface to be painted, said sidewall width being greater than the width of the splay angle of a spray created by said nozzle portion between said nozzle portion and a bottom portion of said sidewalls, said height configured so that a desired spray angle created by said nozzle causes said spray to contact each said sidewall at a bottom portion thereof, said sidewalls terminating at said width so that said paint shield includes two open sides, whereby said spray is substantially contained within said paint shield and wherein said nozzle is maintained at a sufficient distance and angle from said surface being painted so that said surface is completely covered with a surface coating, said open sides allowing said pair of sidewalls to be drawn adjacent said surface during coating thereof, said sidewalls masking surfaces adjacent said surface to be painted.

2. The paint shield of claim 1 wherein said paint shield is constructed from sheet metal.

3. The paint shield of claim 1 wherein each said sidewall foot portion includes a closed hem or an open hem formed along a bottom surface of said at least one sidewall.

4. The paint shield of claim 1 wherein at least one of said side wall foot portions is formed at an oblique angle.

5. The paint shield of claim 1 wherein at least one said side wall foot portion includes at least one wheel mounted for rotation about an axis.

6. The paint shield of claim 1 wherein said top plate includes a rubber seal, said rubber seal being constructed and arranged to cooperate with said nozzle portion to prevent said spray from exiting through said top plate.

7. The paint shield of claim 1 wherein said top plate and said pair of sidewalls are constructed from cardboard, said cardboard having at least one metal strip laminated to an inner or outer surface thereof.

8. The paint shield of claim 1 wherein said top plate and said pair of sidewalls are constructed from cardboard, said cardboard having at least one metal strip embedded therein.

9. The paint shield of claim 1 wherein said top plate and said pair of sidewalls include an inner surface, said inner surface including at least one liner removably secured thereto.

10. The paint shield of claim 7 wherein said planar sheet comprises at least one metal strip configured to maintain said bends for use.

* * * * *